US007264195B2

(12) United States Patent
Fletcher et al.

(10) Patent No.: US 7,264,195 B2
(45) Date of Patent: Sep. 4, 2007

(54) BARBED WIRE INSTALLING SYSTEM USING ALL TERRAIN VEHICLE (ATV)

(76) Inventors: Eddie Fletcher, H.C. 65 Box 27, Rowe, VA (US) 24646; Irvin Ronald Taylor, Route 635, P.O. Box 253, Pilgrims Knob, VA (US) 24634-0253; Jeffrey Street, H.C. 65, P.O. Box 55, Rowe, VA (US) 24646

( * ) Notice: Subject to any disclaimer, the term of this patent is extended or adjusted under 35 U.S.C. 154(b) by 0 days.

(21) Appl. No.: 11/056,079

(22) Filed: Feb. 11, 2005

(65) Prior Publication Data

US 2005/0173584 A1 Aug. 11, 2005

Related U.S. Application Data

(60) Provisional application No. 60/543,532, filed on Feb. 11, 2004.

(51) Int. Cl.
*B65H 75/42* (2006.01)

(52) U.S. Cl. ..... 242/557

(58) Field of Classification Search ..... 242/557, 242/419.4, 597.4, 403, 403.1, 913; 254/323; 224/401, 423
See application file for complete search history.

(56) References Cited

U.S. PATENT DOCUMENTS 2,789,778 A * 4/1957 Zogg et al. ..... 242/423.1
2,914,270 A * 11/1959 Parker et al. ..... 242/390.7
4,946,113 A 8/1990 Riffle et al.
5,174,622 A * 12/1992 Gutta ..... 296/77.1
5,476,234 A * 12/1995 St. Pierre ..... 242/557
5,568,900 A * 10/1996 Conroy ..... 242/557
5,582,216 A * 12/1996 Smith et al. ..... 140/107
5,632,470 A * 5/1997 Leland ..... 254/385
5,709,351 A 1/1998 Osborn et al.
6,016,986 A 1/2000 Wright
6,042,046 A * 3/2000 Beyer, Sr. ..... 242/559.1
6,325,195 B1 * 12/2001 Doherty ..... 192/133
6,425,510 B1 * 7/2002 King ..... 224/401
2003/0230607 A1 * 12/2003 Tweet et al. ..... 224/401
2004/0065767 A1 * 4/2004 Parker ..... 242/557

* cited by examiner

*Primary Examiner*—Patrick Mackey
*Assistant Examiner*—William E. Dondero
(74) *Attorney, Agent, or Firm*—Fliesler Meyer LLP

(57) ABSTRACT

A barbed wire installation mechanism is provided that is supported on an ATV rack with one or more poles extending vertically from the ATV rack onto which one or more barbed wire spools are placed. The mechanism includes a base plate to which the poles are attached. To hold the base plate on the ATV rack, "L" shaped brackets are attached to the base plate opposite the poles. The "L" shaped brackets slide around beams of the ATV rack and serve to hold the base plate on the ATV. A metal securing disk with a center bore fits on the pole and is placed on top of the barded wire spools to prevent the spools from sliding off the poles. A safety frame is further attached to the base plate that supports a screen to prevent the barbed wire from contacting an operator, and provide greater protection for the driver during a rollover.

20 Claims, 9 Drawing Sheets

BARBED WIRE INSTALLING SYSTEM USING ALL TERRAIN VEHICLE (ATV)

CLAIM FOR PRIORITY TO PROVISIONAL APPLICATION

This application claims priority to U.S. Provisional Application Ser. No. 60/543,532, filed Feb. 11, 2004, entitled "Barbed Wire Installing System Using All Terrain Vehicle (ATV)".

BACKGROUND

1. Technical Field

The present invention relates to installing barbed wire from a spool onto fence rails. More particularly, the present invention relates to a device that can support the barbed wire spool, the device being transportable by an ATV for installation of the barbed wire.

2. Related Art

Barbed wire is rolled from a spool making it heavy to carry, and somewhat difficult to handle due to the barbs. Devices have been made to enable attachment of the bail of barbed wire to a tractor so that the wire can be unspooled and attached as the tractor moves along. For more rugged terrain, support systems for use with ATVs have been suggested.

U.S. Pat. No. 6,016,986 entitled "Apparatus For Stringing And Retrieving Fencing" discloses a trailer to pull behind an ATV to unspool wire for attachment. The trailer supports guides disclosed for electric fence wire which, as opposed to barbed wire, will more easily flow through an installation guide mechanism.

Not all ATVs, however, are equipped with a trailer hitch, and pulling a trailer over rugged terrain may not be practical. In such cases, the spool of wire is usually hand carried. Likewise, a trailer or carriage is somewhat complex and difficult to store, and the wire on the trailer is shown supported at a low angle relative to the fence rail making installation more difficult. Systems that directly mount to the ATV, and do not require a trailer have been disclosed, but the systems have some drawbacks due to complexity and the possibility of off-balancing the ATV.

U.S. Pat. No. 5,709,351 entitled "Wire Roller" discloses one such system that can be attached to a rack on an ATV, rather than a trailer, and engages the tire of the vehicle which serves to unroll wire from a spool. The rolling and unrolling mechanism has some complexity, and the wire is supported horizontally at a low position relative to the fence rail. The wire spool which is somewhat heavy is supported by the rack and hangs behind the ATV, well off the normal center of gravity likely causing the ATV to rare up and overturn.

U.S. Pat. No. 4,946,113 entitled "Wire Reel Carrier" discloses another system that supports a wire spool horizontally from an ATV rack. The system carries the spool off the rear of the ATV rack, again likely causing the ATV to overturn. The spool is horizontally mounted with end plates on both ends of the support holding the spool of wire included creating a somewhat complex mechanism to prevent the spool from coming off.

SUMMARY

In accordance with the present invention, a system is provided for supporting a spool of barbed wire on the rack of an ATV. The system is simple to manufacture and attach to the ATV. The system is mounted to minimize offset of weight from the normal center of gravity of the ATV. Further support for the spool of wire holds the wire spool above the rack of the ATV so that the wire is level with the wire attachment point on a fence post. The system further allows the ATV to stretch and hold the wiring in place during attachment to the fence posts.

According to the present invention, a barbed wire installation mechanism is provided that is supported on an ATV rack with a pole extending vertically from the ATV rack onto which a barbed wire spool is placed. The mechanism includes a base plate to which the poles are attached.

To hold the base plate on the ATV rack, "L" shaped brackets are attached to the base plate opposite the poles. The "L" shaped brackets slide around beams of the ATV rack and serve to hold the base plate on the ATV. A pin or screw is used once the L shaped brackets engage the base plate to prevent the base plate from sliding back off.

A metal securing disk with a center bore fitting over the pole is placed on top of the barded wire spools to prevent the spools from sliding off the poles. The securing disk is retained by a cotter pin provided through a hole in the pole.

To install barbed wire using the support mechanism described, the ATV is driven forward causing the spool to unwind after the wire is initially attached to a first fence rail. A clamp attached to the ATV can be used to hold the wire to prevent unspooling, so that the ATV can be driven forward to stretch the wire tight for attachment to a fence pole. The brake of the ATV can be set to hold the wire stretched during attachment.

To improve safety for the ATV operator, a safety frame is further attached to the base plate. The safety frame supports a screen that prevents the barbs on the barbed wire from contacting an operator. The safety frame further provides some protection to the driver should a rollover occur. By placing the barbed wire spools vertically directly over the rack, the normal center of gravity of the ATV is not shifted to the degree that a mechanism supporting the wire spool behind the ATV would create.

According to one embodiment of the present invention, multiple poles can be attached to the base plate above the rack to support multiple barbed wire spools. Since fence rails typically have multiple wires attached, such a mechanism greatly reduces the time required for installing wire on the fence rails.

In other embodiments, with the poles being removable, other items can be attached in their place making the system more versatile than other wire installing mechanisms. For example, the poles can be removed and replaced with a tool box, or simple storage container. The safety frame feature still provides protection to the driver from items that may be in the tool box, as well as better protection from a rollover.

BRIEF DESCRIPTION OF THE DRAWINGS

Further details of the present invention are explained with the help of the attached drawings in which.

DETAILED DESCRIPTION

Figure 1:
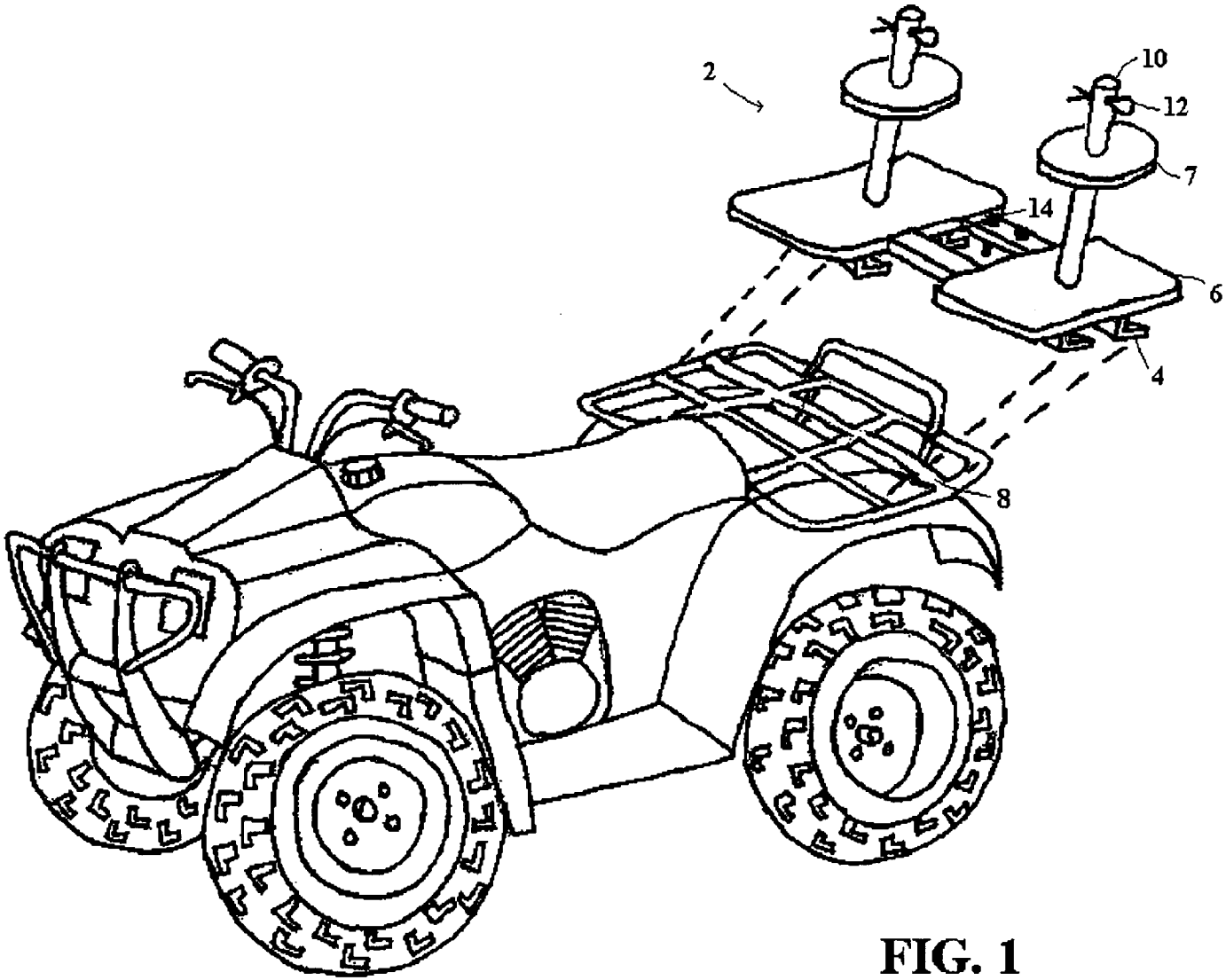
FIG. 1 shows an embodiment of a barbed wire installation system for connection to an ATV rack according to the present invention.

FIG. 1 shows an embodiment of a barbed wire installation system 2 for connection to an ATV according to the present invention. Dashed lines illustrate how the barbed wire installation system 2 attaches to an ATV. As shown, L shaped members 4, or hooks are welded to a steel support plate 6. The L shaped hooks 4 are formed to extend around bars 8 forming the rack of the ATV to prevent the steel plate 6 from sliding off of the ATV rack. The support plate 6 then rests with its surface supported by the ATV rack with the support plate extending horizontally. Poles 10 welded to the steel plate extend vertically from the support plate 6 to support spools of barbed wire.

Round plates 7 shown are used to sit on top of a spool of barbed wire to prevent the barbed wire from sliding off of the poles 10. Although shown as round, other forms may be used as long as the spool of barbed wire is secured. A cotter pin 12 is provided in a hole in each of the poles at an opposite end of the weld to prevent the plate 7 and bail of barbed wire from sliding off when it is installed. Locking bolts 14 are provided in small holes in the support plate 6 once the L shaped hooks 4 are installed around the bars 8 of the ATV rack to lock or prevent the L shaped hooks 4 from sliding off of the bars 8 so that the plate 6 does not slide off of the ATV rack particularly with a load applied as when barbed wire is being pulled off a spool.

Figure 2:
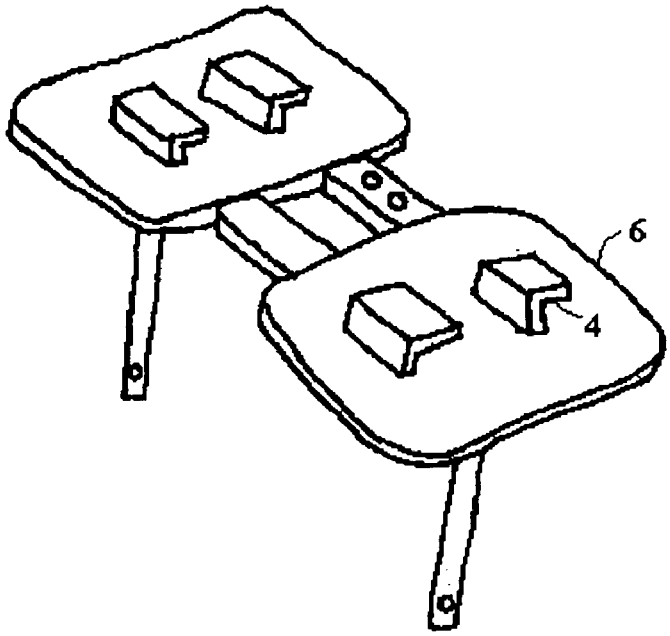
FIG. 2 illustrates how "L" shaped hook members are attached to the support plate to mount the support plate on an ATV rack.

FIG. 2 illustrates how the L shaped hook members 4 are shaped, and how they are attached to the support plate 6 in one embodiment. In FIG. 2, the L shaped hook members 4 are shown welded to the support plate 6.

Figure 3:
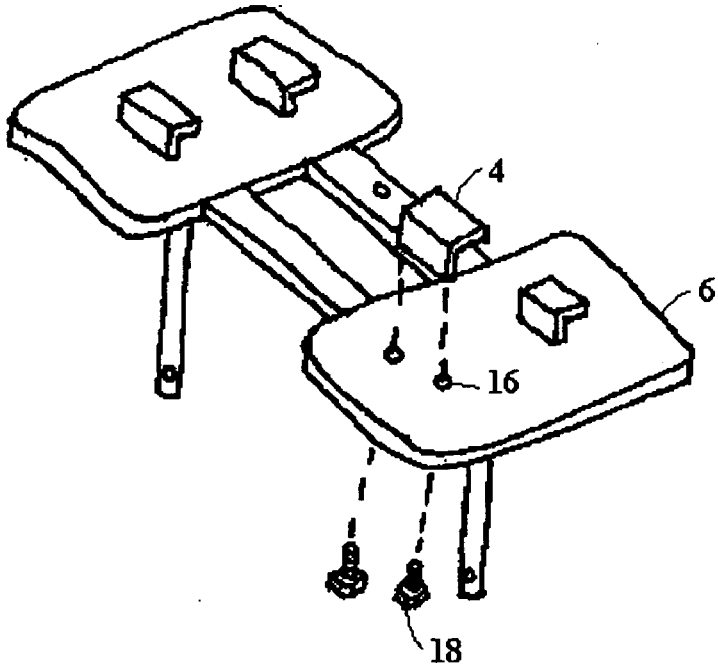
FIG. 3 illustrates how the "L" shaped hook members can be bolted to the support plate.

FIG. 3 illustrates how the L shaped hook members 4 can be bolted to the support plate 6 as opposed to being welded. In FIG. 3, two holes 16 are drilled through the support plate 6 through which bolts 18 are inserted and screwed into tapped holes drilled in the L shaped hook members 4. In one embodiment, counter sinking of the bolt holes 16 in the support plate 6 is provided so that the heads of the bolts 18 do not interfere with rotation of the barbed wire spool. Alternatively, the bolt holes 16 are provided at locations away from where the barbed wire spool will set so that counter sinking is not necessary.

Figure 4:
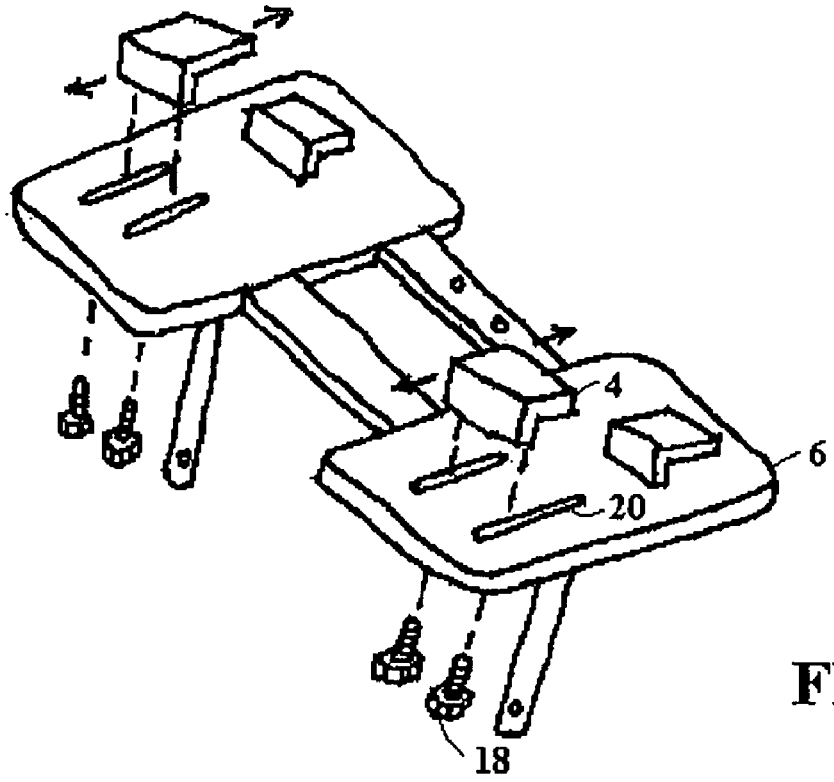
FIG. 4 illustrates how the "L" shaped hook members can be bolted onto the support plate by bolts applied through slots cut into the support plate allowing the adjustment of the support plate on an ATV rack.

FIG. 4 illustrates how the L shaped hook members 4 can be bolted onto the support plate 6 by bolts 18 applied through slots 20 cut into the support plate 6. The slots 20 enable the position of the support plate 6 to be adjusted before it is bolted on to fit different sized ATV racks. Variation in the separation of the rack bar 8 on ATV racks is typical between manufacturers. Although a dimension can be chosen which can fit the racks of most ATVs, the slots 20 will enable positioning of the L shaped hook members 4 so that the supports are an exact fit to the rack and are less likely to move during operation of the ATV. As with the holes of FIG. 3, counter sinking can be provided in the slots to prevent the bolt heads from interfering with rotation of a spool of barbed wire.

Figure 5:
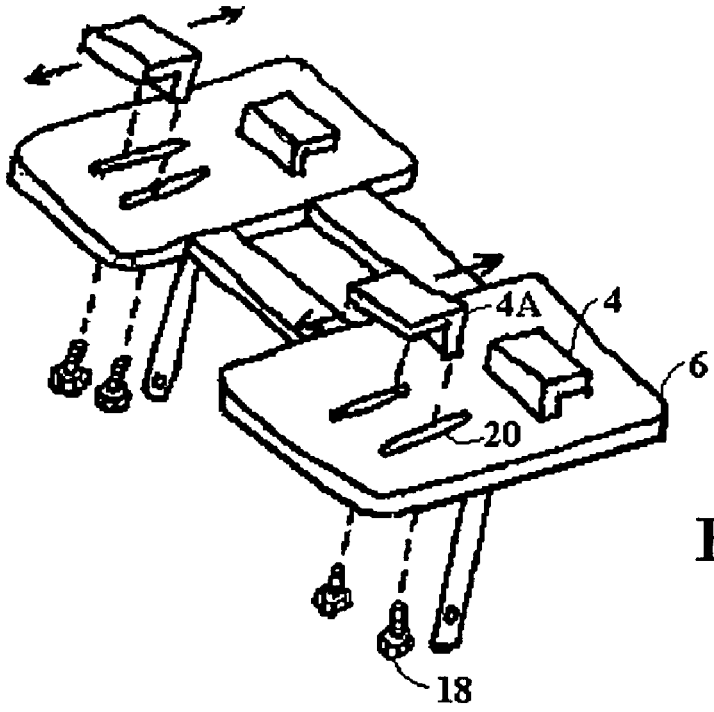
FIG. 5 shows an alternative to FIG. 4, where the L shaped hooks are attached in an opposing relation on the support plate.
Figure 6:
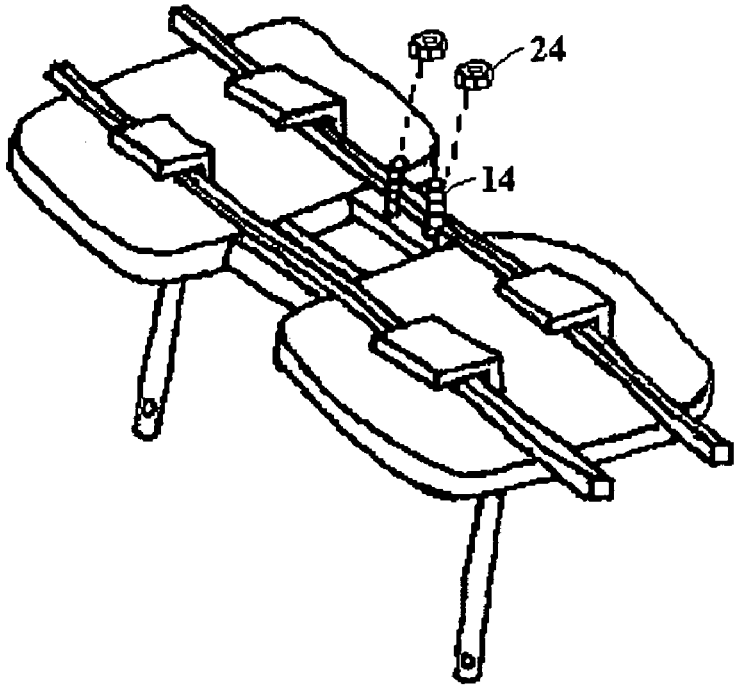
FIG. 6 shows locking bolts used with the barbed wire installing system of FIG. 2 to prevent the support plate from sliding off the ATV rack.

FIG. 5 provides the same support plate 6 as in FIG. 6 with slots 20 provided for bolting on the L shaped hook members. FIG. 5, however, shows an alternative embodiment where the L shaped hooks 4A is attached to the support plate in an opposing relation to hooks 4. The opposing relationship enables the L shaped hooks to rigidly attach the support plate to the ATV rack without using locking bolts 14 (as shown in FIG. 1) while still keeping the support plates from sliding off of the ATV rack.

FIG. 6 shows the locking bolts 14 used with the barbed wire installing system as shown in FIG. 2. Nuts 24 are screwed onto the locking bolts 14 to keep them from sliding out during operation.

Figure 7:
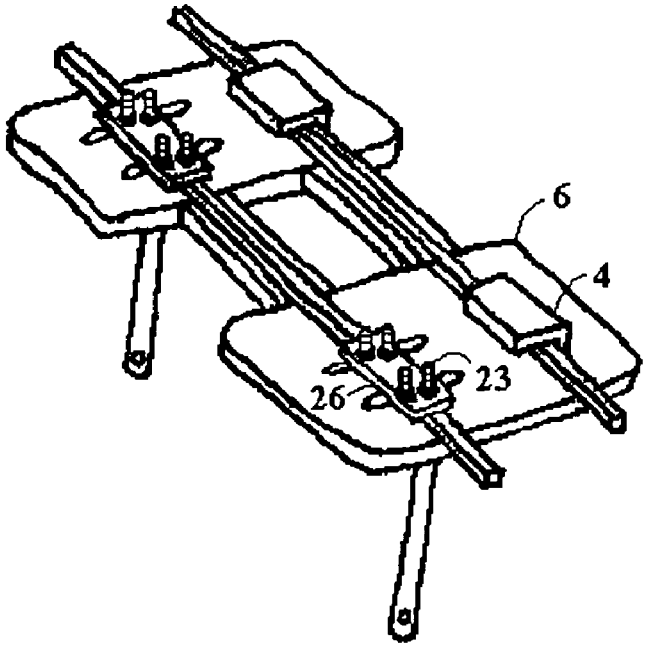
FIG. 7 shows that as an alternative to the "L" shaped hooks for holding the support plate on the ATV rack, the alternative including a flat rectangular plate with four attachment blots.

FIG. 7 shows that as an alternative to the L shaped hooks 4, rectangular plates 26 can be used with four blots 23 attaching to the support plate 6. As with the opposing L shaped hooks 4, with the rectangular plates 26 and four bolts 23, the locking bolts 14 are no longer necessary.

Figure 8:
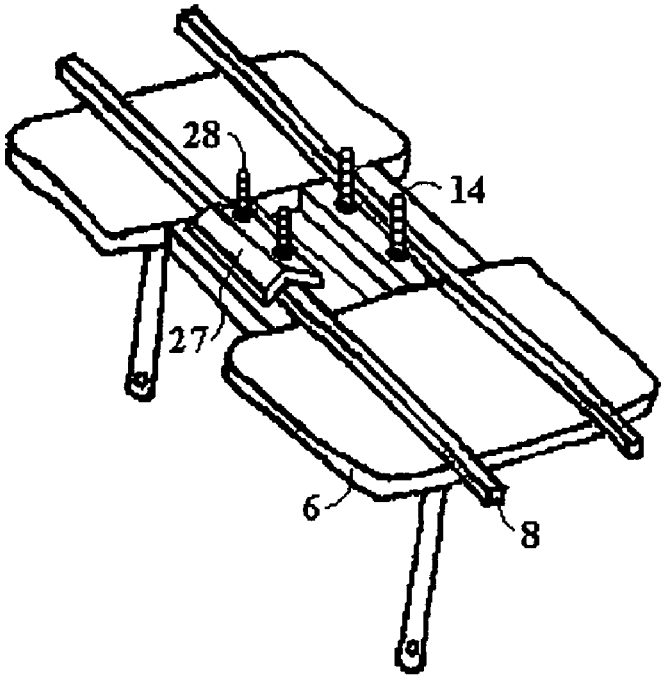
FIG. 8 an angle plate as an alternative shows an alternative to the flat rectangular plate of FIG. 7.

FIG. 8 shows an alternative to flat rectangular plates 26 of FIG. 7, an angle plate 27 can be used having a bend to hold the ATV frame bar 8 to prevent the support plate 6 from sliding off of the ATV frame 8, even with only two bolts 28 inserted to hold angle plate 27 to the support frame 6. With the angle plate 27 having a bend used, the ATV rack bar 8 is further engaged to prevent rotational movement of the support plate 6 so that a second attachment device is not as important to secure the support plate 6 to prevent rotation. Instead only locking bolts 14 are used to prevent sliding of the support plate 6 relative to the ATV frame.

Figure 9:
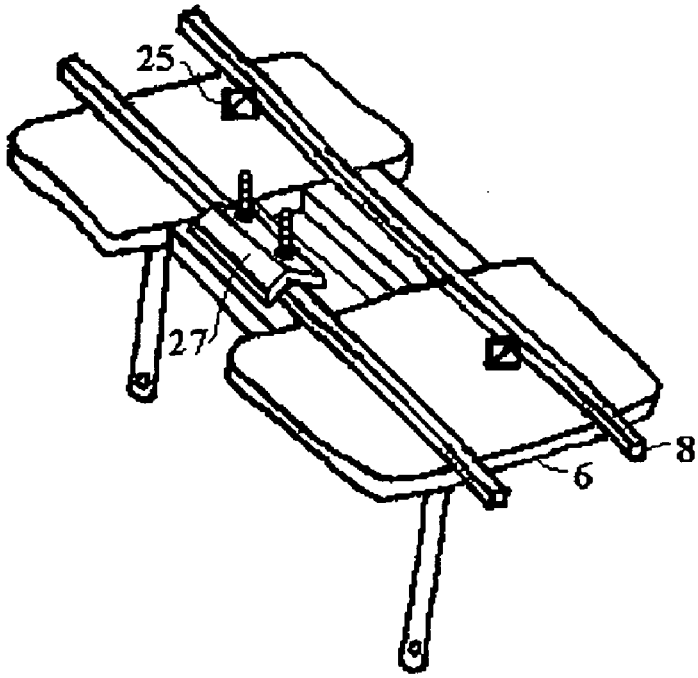
FIG. 9 shows an alternative to the configuration of FIG. 8 with indentations in the support plate replacing locking bolts.

FIG. 9 shows an alternative to the configuration of FIG. 8 with indentations 25 provided in the support plate 6 replacing bolts 14 to prevent sliding of the support plate 6 relative to the ATV rack bar 8 when an angle plate 27 is used. The indentations 25 are formed by cutting an opening in the support plate 6, and then bending the metal around the opening so that the indentation 25 extends to engage the ATV rack bar 8.

Figure 10:
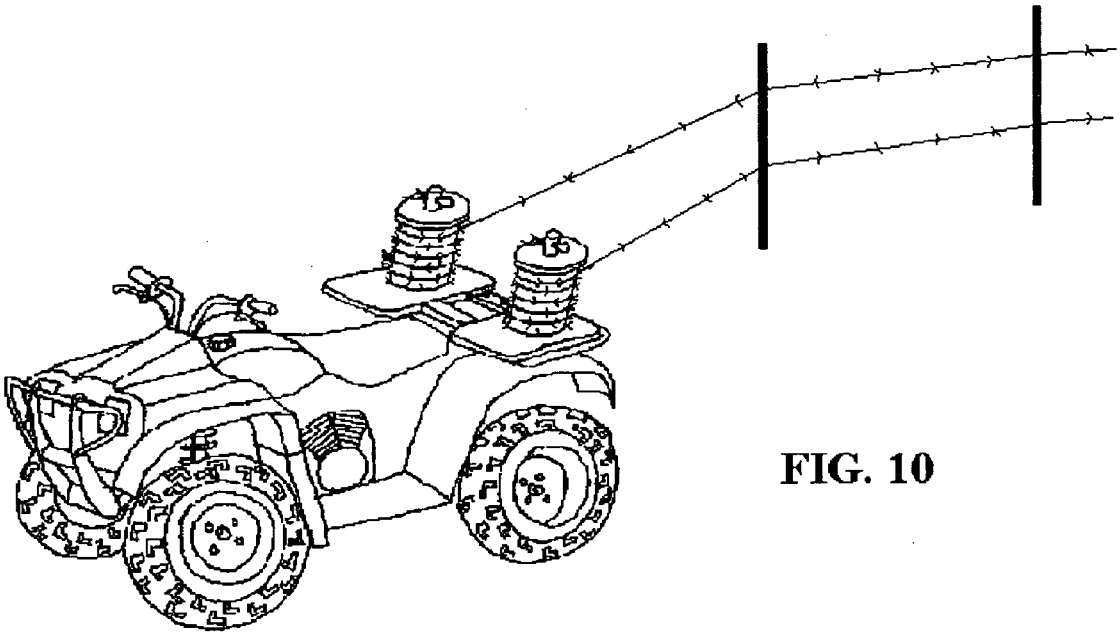
FIG. 10 illustrates an ATV and barbed wire installation system with two spools of barbed wire being attached to a fence.

FIG. 10 illustrates an ATV and barbed wire installation system with two spools of barbed wire being attached to a fence. Although the system is shown used to install barbed wire, it is contemplated that it may be used to install other wiring such as electric fence wiring, or telephone wire. As shown, the system can be used to install two wires at a time.

Figure 11:
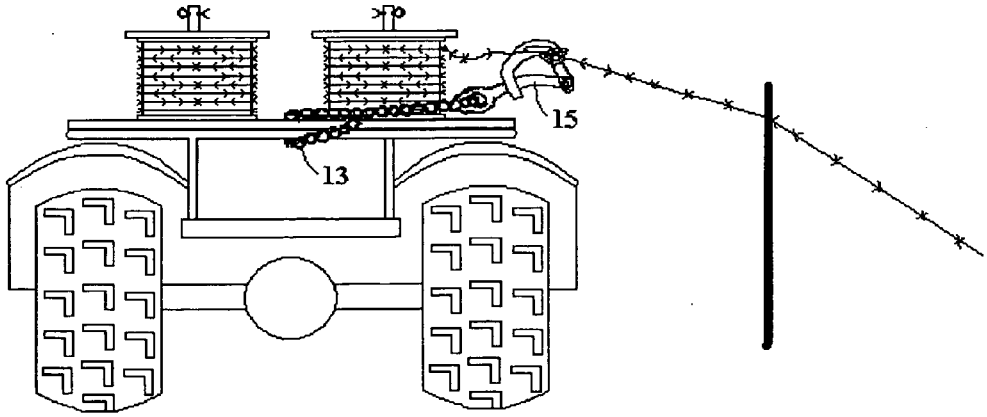
FIG. 11 illustrates the ATV and barbed wire installation system, further including a cable clamp attached to the ATV allowing for stretching the barbed wire cable using the ATV.

FIG. 11 illustrates the ATV and barbed wire installation system, further including a cable clamp 15 connected to a chain 13 attached to the ATV for stretching the barbed wire cable when attaching to a fence pole. The chain 13 can be looped around the installation system or around the ATV rack, and then the ATV can be used to pull the cable clamp 15 tight before the wire is attached to fence pole. Alternatively a chain or other attachment device can attach the cable clamp 15 to a support pole 10. As a further alternative, the cable clamp 15 itself can be hooked over the support pole 10. A device like a come-a-long or other wire puller using operator pressure for stretching, as opposed to the pulling power of the ATV will then not be required, making wire installation simpler.

Figure 12:
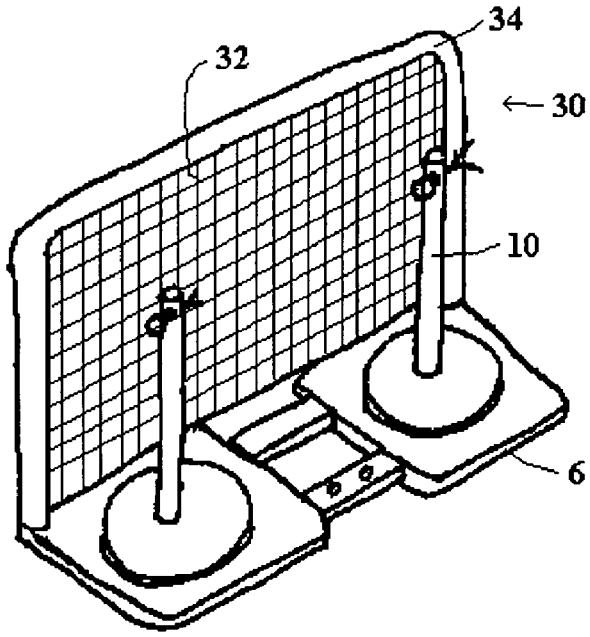
FIG. 12 shows an embodiment of the barbed wire installation system with a wire safety barrier.
Figure 13:
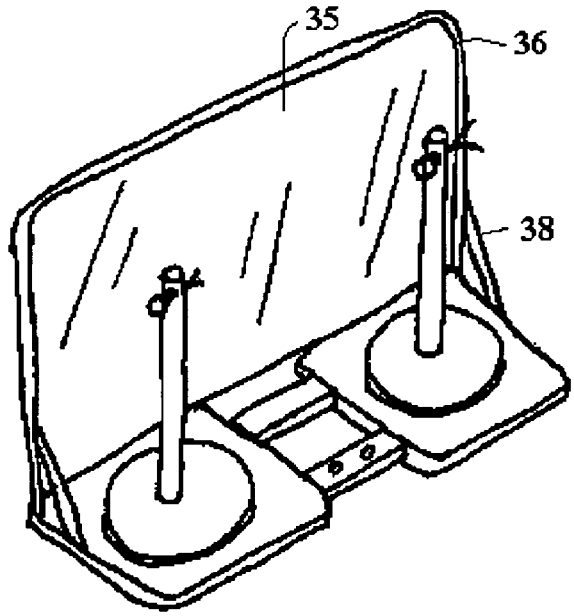
FIG. 13 illustrates a transparent safety barrier as an alternative to the wire barrier of FIG. 12.

FIG. 12 shows another alternative embodiment of the barbed wire installation system with a safety barrier 30 between the ATV operator and the poles 10 which support bails of barbed wire. The safety barrier 30 can be a metal screen 32 with a metal frame 34 attached to the support plate 6 as shown in FIG. 12. As an alternative to the metal screen or plate 32, a flexible transparent polymer such as Plexiglas™ 35 may be used as illustrated in FIG. 13, although a polymer like Plexiglas™ 35 will be more subject to scarring by barbed wire. Further, to reduce weight as shown in FIG. 13, a thinner frame 36 may be used with an angle brace 38 attached between the frame 36 and support plate 6. The barrier 30 is intended to prevent the ATV operator from coming into contact with the barbed wire. As a note, with a strong enough support frame and a strong ATV rack, a roll bar is effectively provided improving the safety of the ATV by providing better protection to the ATV operator during a rollover.

Figure 14:
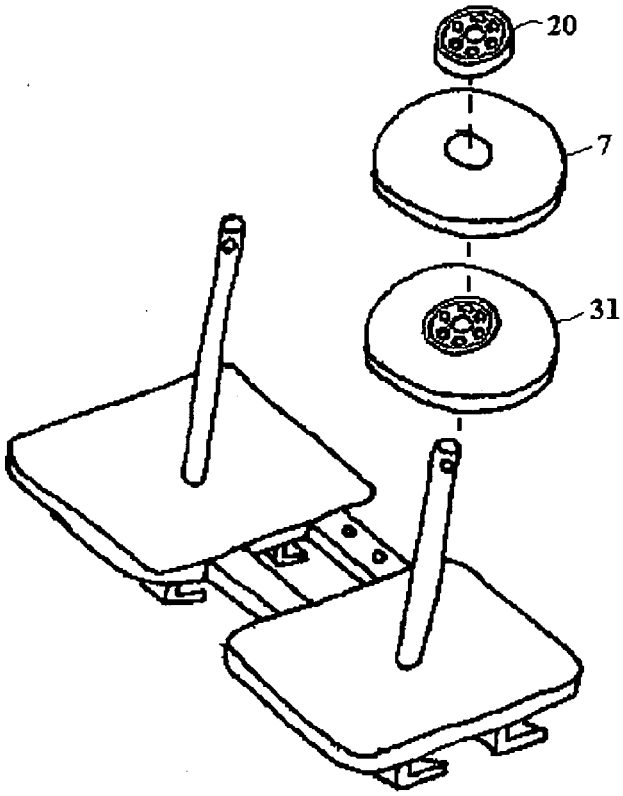
FIG. 14 illustrates how the round plate shown in FIG. 1 can be modified to include a bearing for ease of rotation.

FIG. 14 illustrates how the round plate 7 shown in FIG. 1 can be modified to include a bearing 20 for ease of rotation. A second round plate 31 is shown illustrating that two plates 7 and 31 with bearings can be provided for each end of a spool of barbed wire to allow even more free rotation of the spool. The round plates 7 and 31 serve to both support the barbed wire bails and to rotate to enable the barbed wire to easily be unwound from the bails and attached to fence posts. For illustration, two round plates are shown with a bearing installed to improve rotation of the plate. Use of plates without bearings, or a single plate as shown in FIG. 1, however, is optional.

Figure 15:
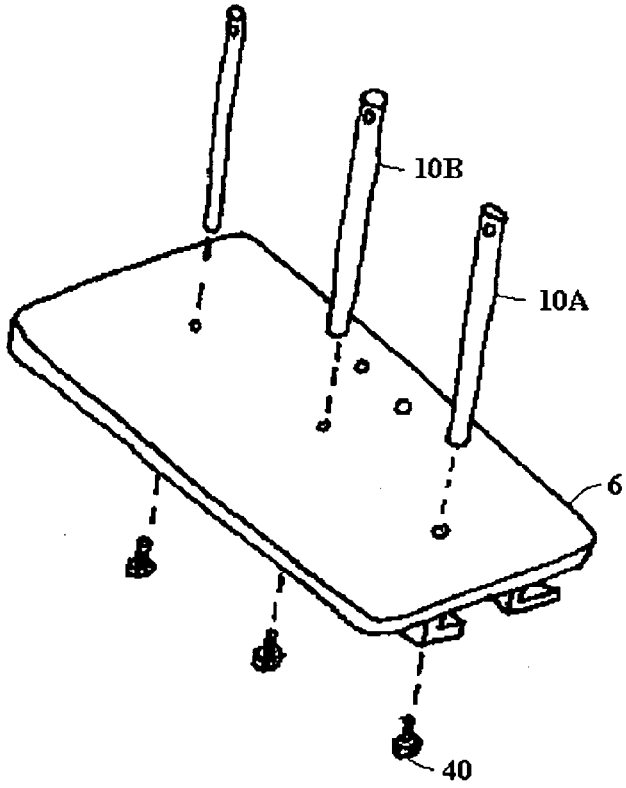
FIG. 15 illustrates how the support plate can be a solid sheet of metal.

FIG. 15 illustrates first that the support plate 6 may be a solid sheet of metal. In FIG. 1, the support plate is shown with portions cut away to reduce the overall plate weight. The barbed wire installation system is preferably made from steel to provide the strength needed to stretch the barbed wire during installation without deforming, as well as to stand up to scraping occurring from the steel barbed wire. However other materials can be used for the support plate.

FIG. 15 also illustrates that the poles 10A for supporting the barbed wire bails may be attached by bolts instead of welds to enable an optional third pole 10B to be included. The third center pole 10B is intended for use when installing only a single bail of barbed wire, while the other two poles are removed. Otherwise, the third center pole is removed while the other two poles are installed to enable two bails of barbed wired to be installed at the same time. In one embodiment, the center pole 10B is extended to allow two spools of barbed wire to be stacked on vertically above the support plate. Likewise, the poles 10A can support stacked spools of barbed wire to enable multiple strands to be installed on a fence rail at one time.

Figure 16:
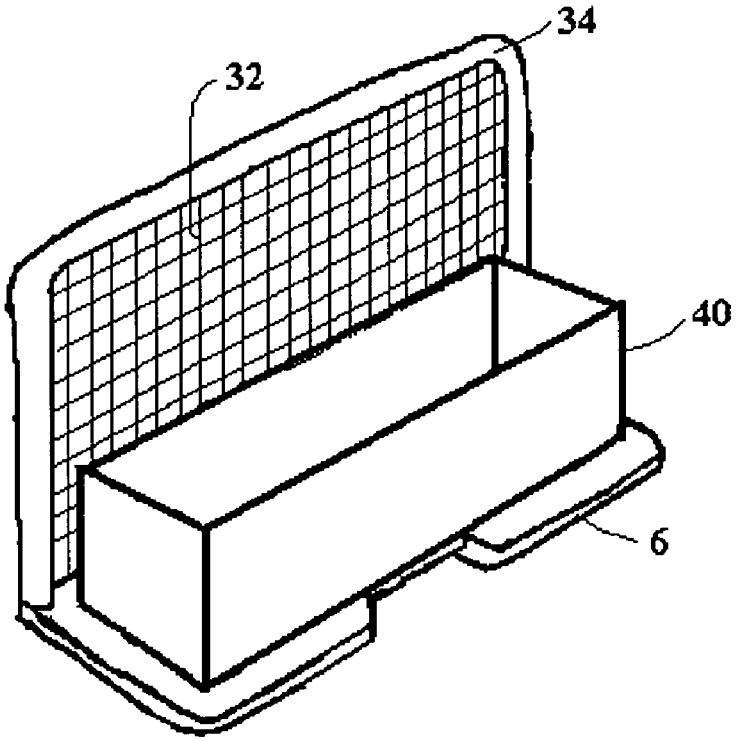
FIG. 16 illustrates that the poles can be removed and replaced by items such as a storage container.

FIG. 16 illustrates that the poles can be removed and replaced by other items that are bolted down. For example, the poles can be replaced by the storage container or tool box 40 shown. This creates a versatile support system useful for multiple purposes, while still being easy to manufacture and store. Even with the tool box 40 attached, the safety screen 32 provides the ATV operator protection from tools or other items stored, and the safety frame 34 supporting the screen provides improved driver protection should a rollover occur.

Although the present invention has been described above with particularity, this was merely to teach one of ordinary skill in the art how to make and use the invention. Many additional modifications will fall within the scope of the invention, as that scope is defined by the following claims.

What is claimed is:

1. A wire installation system comprising:

an All Terrain Vehicle (ATV) having front and rear wheels and a rack mounted over the rear wheels;

a support plate mounted on the rack of the ATV;

at least one pole attached to the plate so that a spool of wire mounted on the pole will extend over and above the rear wheels of the ATV; and brackets having an "L" shape attached to the support plate opposite the at least one pole, the L shape bracket and plate together extending around three sides of a bar of the rack and leaving a fourth side open for slidably attaching the support plate to the rack of the ATV.

2. The wire installation system of claim 1 further comprising:

a cable clamp configured to attach to the ATV enabling clamping of the wire so that tension can be applied to the wire by movement of the ATV while tension is limited on the wire on the spool.

3. The wire installation system of claim 1, further comprising:

a securing plate for providing over the pole to rest on top of the spool of wire to limit vertical movement of the spool of wire.

4. The wire installation system of claim 3, further comprising:

a pin provided through the pole to prevent the securing plate from sliding vertically off of the pole.

5. The wire installation system of claim 1 further comprising:

an attachment plate with at least one hole, the attachment plate configured to engage the ATV rack; and at least one bolt for providing through the hole in the attachment plate to secure the attachment plate to the support plate.

6. The wire installation system of claim 1, further comprising:

a safety barrier attached to the support plate between the at least one pole and a seat of the ATV, the barrier to limit contact of an operator in the seat and a spool of barbed wire provided on the pole.

7. The wire installation system of claim 6, wherein the safety barrier comprises a frame attached to the support plate supporting a screen.

8. The wire installation system of claim 7, wherein the frame comprises a "U" shaped bar secured on opposite ends of the support plate and extending substantially vertically from the support plate above the ATV rack.

9. The wire installation system of claim 1, wherein at least two of the poles are attachable to the support plate.

10. The wire installation system of claim 1, wherein the wire comprises barbed wire.

11. The wire installation system of claim 1, wherein the pole is long enough to stack more than one spool of wire vertically above the support plate on the pole.

12. The wire installation system of claim 1, further comprising:

a pin provided through a hole in the support plate, the pin intending to engage the rack to prevent the support plate from sliding off of the rack once the "L" shaped brackets engage the rack of the ATV.

13. A wire installation system for use with an All Terrain Vehicle (ATV) comprising:

a support plate configured to mount on a rack of the ATV; and at least one pole attached to the plate to extend from the plate over and above the rack of the ATV, the at least one pole for mounting a spool of wire;

means for attaching the support plate to the rack of the ATV; and an indentation provided in the support plate for engaging the rack of the ATV.

14. An apparatus for use with an All Terrain Vehicle (ATV) comprising:

a support plate configured to be removably mounted on a rack of the ATV so that the support plate rests above the rack, the support plate including at least one mechanism to enable mounting of objects on the support plate; and brackets having an "L" shape attached to the support plate, the L shaped bracket and plate together extending around three sides of a bar of the rack and leaving a fourth side of the bar open for slidably attaching the support plate to the rack.

15. The apparatus of claim 14, further comprising:

a frame comprising a "U" shaped bar secured on opposite ends of the support plate and extending vertically from the support plate over and above the rear wheels of the ATV.

16. The apparatus of claim 15, further comprising:

at least one pole attachable by a bolt to the support plate, the pole for extending from the support plate over and above the rack of the ATV, the at least one pole for mounting a spool of wire.

17. The apparatus of claim 15, further comprising:

a container box attachable by at least one bolt to the support plate, the container box for extending from the support plate over and above the rack of the ATV.

18. The apparatus of claim 15, further comprising a screen attached to the frame.

19. The apparatus of claim 14, wherein the rack is positioned over and above tires of the ATV.

20. The apparatus of claim 14, wherein the mechanism to enable mounting of objects on the support plate comprises at least one bolt hole formed in the plate.

* * * * *